US005515874A

United States Patent [19]

Denebeim

[11] Patent Number: 5,515,874

[45] Date of Patent: May 14, 1996

[54] SPHERICAL HAIR CURLER AND METHOD FOR USING SAME

[76] Inventor: Sabrina Denebeim, 260 Avila St., San Francisco, Calif. 94123

[21] Appl. No.: 363,256

[22] Filed: Dec. 23, 1994

[51] Int. Cl.[6] ..... A45D 2/12

[52] U.S. Cl. ..... 132/226; 132/233; 132/237; 132/238; 132/210; D 28/37

[58] Field of Search ..... 132/210, 211, 132/223, 226, 233, 238, 237, 252; D28/35, 37

[56] References Cited

U.S. PATENT DOCUMENTS

| | | | |
|---|---|---|---|
| 3,204,646 | 9/1965 | Zhanberlin | D28/37 |
| 3,413,984 | 12/1968 | Tracy et al. | 132/238 |
| 4,291,714 | 9/1981 | Mariani | 132/233 |
| 4,431,012 | 2/1984 | Albertoni | 132/233 |
| 4,502,496 | 3/1985 | Thomas et al. | 132/233 |

*Primary Examiner*—John G. Weiss

*Attorney, Agent, or Firm*—Majestic, Parsons, Siebert & Hsue

[57] ABSTRACT

A spherical curler and method for using same are provided to enable a user to obtain a helical curl having a continue of varying diameters within each lock of curled hair. This varying diameter helix provides a new and distinct look for the curled hair. In addition, the spherical configuration allows more curlers to be placed on the head as compared to conventional cylindrical curlers having the same sized diameter. Also, the spherical configuration of the curler provides for less wasted space on the curler, and allows each curler to be more completely utilized for each respective lock of hair.

20 Claims, 4 Drawing Sheets

SPHERICAL HAIR CURLER AND METHOD FOR USING SAME

BACKGROUND OF THE INVENTION

This invention relates generally to personal grooming devices, and more particularly to devices useful for hairstyling and for curling locks of hair.

Many persons with straight hair wish to temporarily alter their hairstyle through techniques such as curling, blowdrying, ironing, and/or perming. It has been customary in grooming hair to roll a tress or a plurality of strands of hair on a cylindrical curler and to apply a moistening agent to the hair. The hair is left in its rolled state until it has dried and set. After the hair has set, the cylindrical curlers are removed and the hair retains a curl or wave imparted by the cylindrical curler.

However, the curl imparted by a typical cylindrical curler is limited to the constraints of a constant diameter roller. The resultant lock of hair which has been curled using this technique forms a helical shape having a relatively constant diameter. Small diameter cylindrical rollers produce small helixes and large diameter cylindrical rollers produce large helixes. Additionally, much space on the cylindrical curler is wasted because a majority portion of each lock of hair is rolled around the center portion of the curler, leaving the end portions of the curler unused and visually devoid of hair.

It is therefore an object of the present invention to overcome the disadvantages associated with conventional cylindrical curlers, and to provide a novel hairstyling technique for styling hair into shapes which cannot be achieved using conventional cylindrical curlers.

SUMMARY OF THE INVENTION

This and additional objects of the present application are accomplished by the various aspects of the present invention, wherein briefly, according to a principal aspect, a spherical curler is provided to enable a user to obtain a helical curl having a continuum of varying diameters within each lock of curled hair. This varying diameter helix provides a new and distinct look for the curled hair. In addition, the spherical configuration allows more curlers to be placed on the head as compared to conventional cylindrical curlers having similarly sized diameters. Also, the spherical configuration of the curler provides for less wasted space on the curler, and allows each curler to be more completely utilized for each respective lock of hair.

According to a first aspect of the present invention, a hairstyling device is provided which includes a curler having a substantially spherical body. The body includes at least one receptable disposed therein for receiving a shaft of a handle, wherein the receptable includes means for transferring torsional force exerted from the shaft to the body, to thereby cause the body to rotate as the shaft rotates. The spherical curler in accordance with this aspect of the present invention is useful for attachment to a shaft of a hairbrush, or to an automated hair winding device.

According to a second aspect of the present invention, a hairstyling device is provided which includes a curler having a substantially spherical body. The curler further includes a conformal layer of material covering at least a portion of an outer surface of the body, wherein the layer of material includes a plurality of minute hook-shaped gripping elements for gripping the locks of hair of the user. Additionally, the body and layer of material each includes a plurality of apertures for allowing air to flow into and out from an interior cavity of the curler.

A third aspect of the present invention is directed to a method for styling hair using a curler having a substantially spherical body and a plurality of minute hook-shaped gripping elements on an outer surface of the body. The method comprises the steps of applying the curler to a portion of the hair in a manner to engage the gripping elements with the hair portion; rotating the curler about a first axis in a manner to wind at least a first portion of the hair portion about the curler; and rotating the curler about a second axis in a manner to wind at least a second portion of the hair portion about the curler. Thus, while a lock of hair is being wound around the spherical curler, the axis of rotation of the curler may be changed during the winding or rolling process, before all of the hair is completely wound around the curler, to thereby allow for individualized hairstyling techniques for each curler. Such a hairstyling technique is not achievable using conventional cylindrical curlers since the cylindrical curler only allows for a single axis of rotation while winding hair around the curler.

A fourth aspect of the present invention is directed to a method for styling hair using the spherical curler of the present invention in a manner to achieve results similar to that of a perm rod. The method includes the steps of winding a first portion of hair around a spherical curler; applying a perm solution to the wound portion of hair; removing the perm solution from the hair portion after an amount of time has elapsed sufficient to allow the solution to set the hair portion; and unwinding said hair portion from said curler after the perm solution has been removed. Using this method, the hair of a user can be permed with the shape of the curls retaining a helical shape having a continuum of differing diameters.

Additional objects, features and advantages of the various aspects of the present invention will become apparent from the following description of the preferred embodiment, which description should be taken in conjunction with the accompanying drawings.

DETAILED DESCRIPTION OF THE PREFERRED EMBODIMENT

Figure 1A:
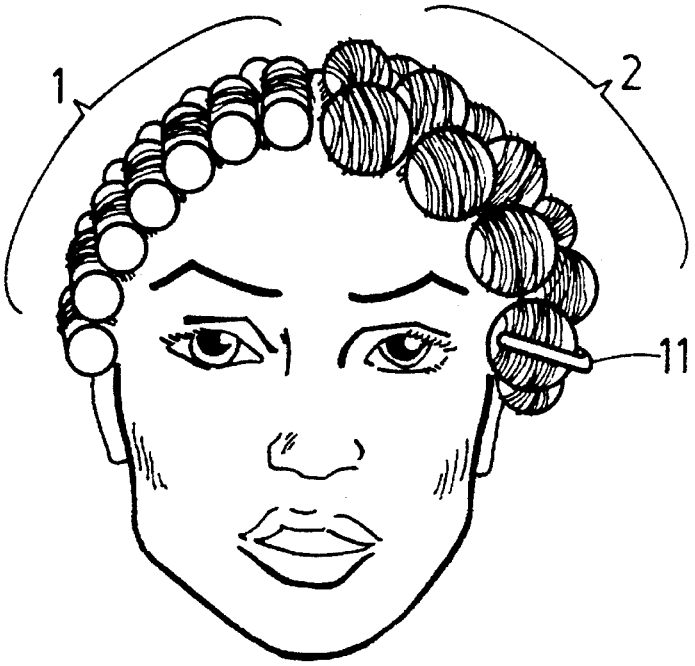
FIG. 1A shows a front view of a woman using conventional curlers 1 on the left side of her head and using spherical curlers 2 on the right side of her head.

FIG. 1A is a front view of a woman with conventional curlers 1 on the left side of her head (as viewed by the viewer), and spherical curlers 2 on the right side of her head. Although the spherical curlers 2 in FIG. 1A are depicted as all being the same size, it is to be understood that the spherical curler of the present invention may be manufactured in a variety of sizes, each of which is available to a user to be used as shown in FIG. 1A. Thus, spherical curlers of differing sizes may be used during a particular hairstyling session.

The unique spherical shape and different sizes of the curler of the present invention also allows the user to apply more curlers to a given area of the scalp (or other desired portions of the body). This, in turn, allows a user to increase the actual amount of curls within a given area. The ability to increase the amount of curls creates a unique "maxi" curl style which heretofor has not been possible using conventional, cylindrical curlers. Moreover, the very act of winding hair around the outer surface of the spherical curler itself induces the unique, full bodied, hair style, which is described in greater detail below.

Figure 1B:
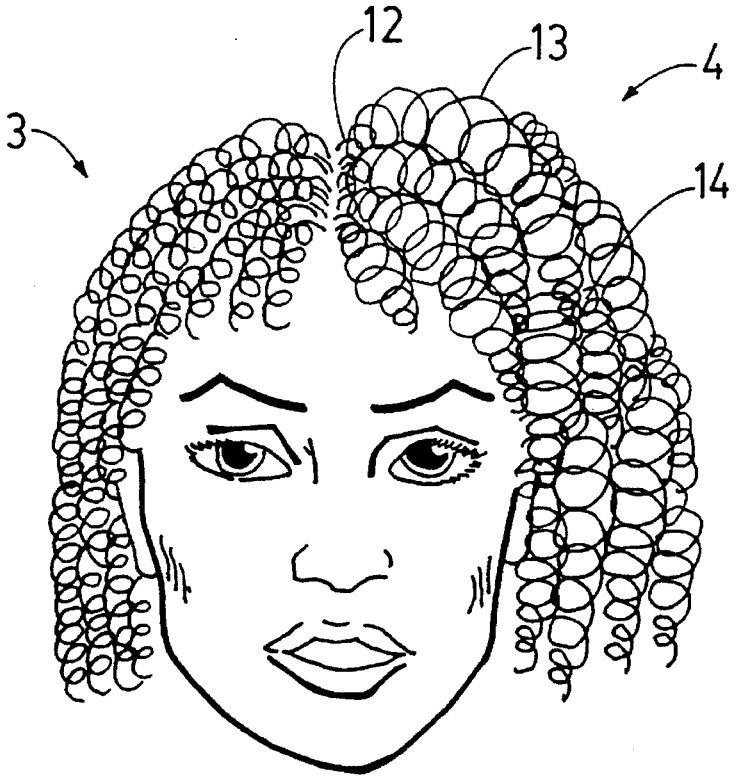
FIG. 1B illustrates the woman's hair after the curlers have been removed, showing curls 3 resulting from conventional curlers and showing curls 4 resulting from the spherical curler of the present invention.

FIG. 1B illustrates the various resulting curls which form using the different types of curlers shown in FIG. 1A. It is to be noted that the curls shown in FIG. 1B are for illustrative purposes, and are indended to exemplify the differences between curls obtained from conventional cylindrical curlers and curls obtained from the spherical curler of the present invention.

Curls generally depicted at 3 result from the conventional curlers 1 of FIG. 1A. A closer inspection of the curls 3 reveals that the conventional curler produces curls in a helical shape, wherein each of the curls in the helix has substantially the same diameter. This is the result of the hair being wrapped around a cylindrical curler which has a single diameter.

In contrast, the curls shown generally at 4 in FIG. 1B result from using the spherical curler of the present invention, as shown in FIG. 1A. Because different portions of hair are wrapped around a single spherical curler at different locations on the curler, the diameter of the resulting curls will vary, depending upon the diameter portion of the spherical curler onto which each part of hair is wound. The curls 4 which result using the spherical curler of the present invention retain a helical shape with a continuum of differing diameters. For example, as shown in FIG. 1B, the resulting curls 4 start out having a small diameter 12, then progresses to a larger diameter 13, and again reduce to a smaller diameter 14. Thus, the use of a spherical curler provides the unexpected advantage of producing a helical curl with a continuum of differing diameters, as shown generally at 4 in FIG. 1B.

Figure 2A:
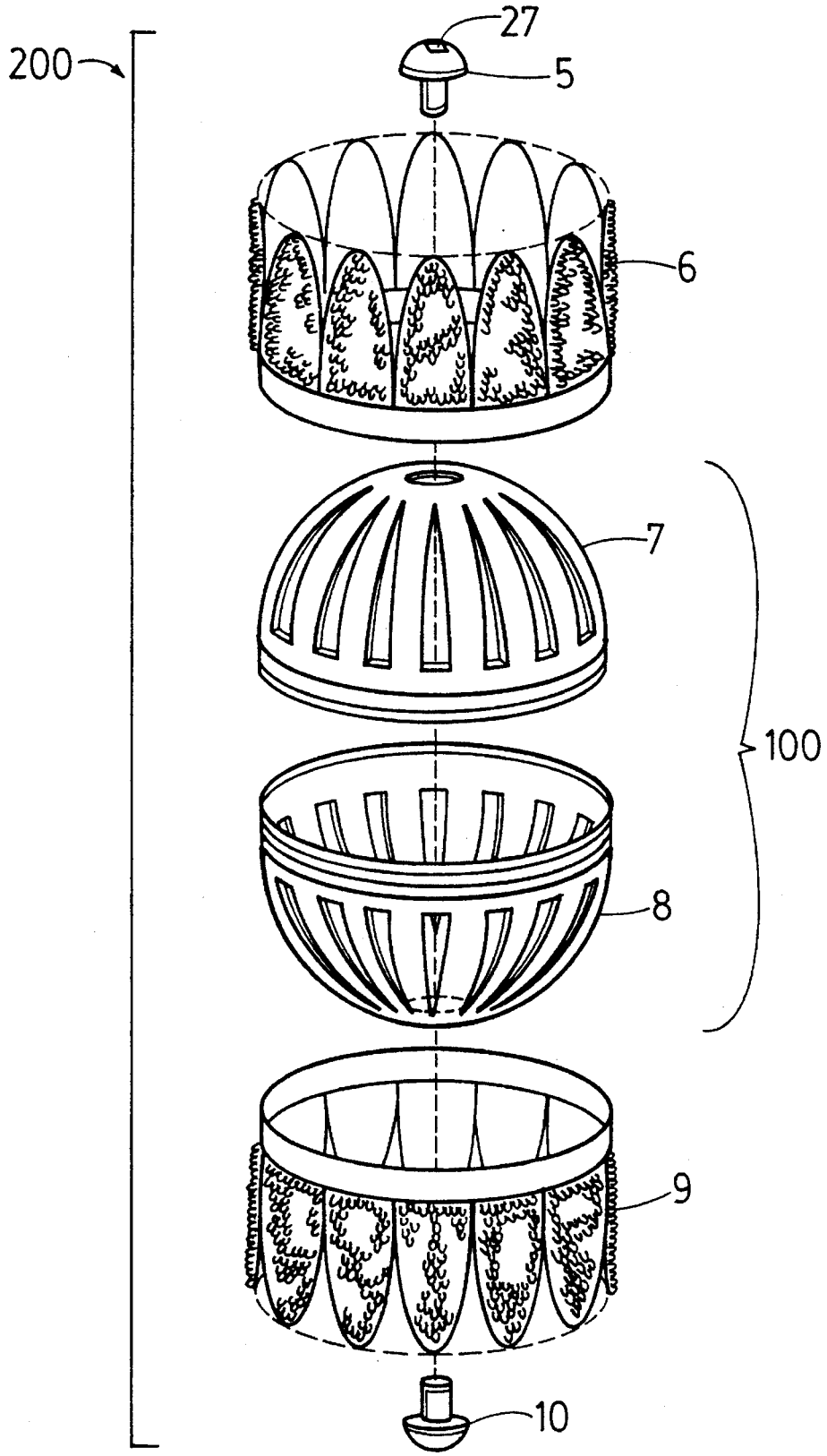
FIG. 2A is an exploded view showing the construction of a first embodiment of the spherical curler of the present invention.

FIG. 2A shows an exploded view of a first embodiment of a spherical curler of the present invention. As illustrated, the spherical curler of the present invention comprises a substantially spherical body 100. Body 100 may preferably be comprised of a sturdy, lightweight material such as, for example, plastic. Other materials generally know to those skilled in the art may also be used, such as, for example, metal (discussed below).

As shown in FIG. 2A, the substantially spherical body 100 may be formed by joining together two hemispheres 7 and 8. Alternatively, the substantially spherical body 100 may be fabricated in one piece (not shown). Where the body is formed by joining together two hemispheres 7 and 8, the joining technique may be any technique which is commonly known to those skilled in the art such as, for example, the use of adhesives or ultrasonic welding.

A conformal layer of material 6 and 9 covers at least a portion of the outer surface of the body 100. Each layer of material 6 and 9 includes a plurality of minute hook-shaped gripping elements (such as, for example, Velcro™) for gripping hair of a user. The spherical configuration of curler 200 facilitates the ease in which the gripping elements are able to "catch" the hair, thereby making it easier to wind the hair around curler 200 from any starting point.

The layer of hair gripping material is specifically designed for spherical curler applications by forming or cutting the layer into a pattern which will allow it to conform to the outer surface of a spherical body 100. An example of such a pattern is illustrated in FIG. 3, wherein a flat strip of hair gripping material 15 is shown which has been pre-cut into a pattern allowing strip 15 to be wrapped around a widest perimeter of the spherical body 100, and to conform to at least a portion of the spherical body. The layer of material 15 may be secured to the body 100 by one of many techniques known to those skilled in the art such as, for example, by using an adhesive. After layers 6 and 9 have been wrapped onto hemispheres 7 and 8 (FIG. 2A), the resultant curler will appear similar to that as shown in FIG. 2B.

Figure 2B:
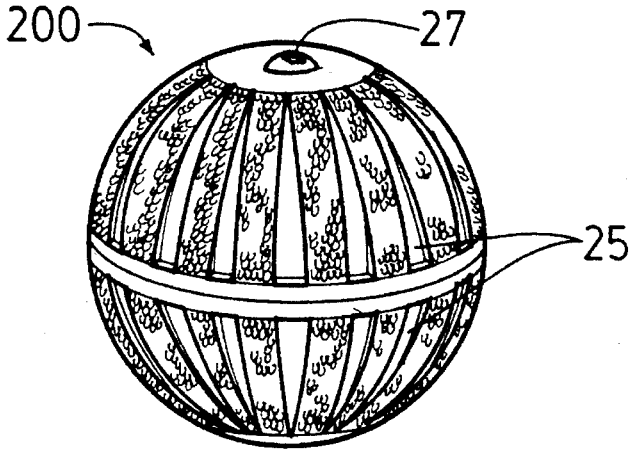
FIG. 2B is a perspective view showing an assembled single spherical curler.
Figure 3:
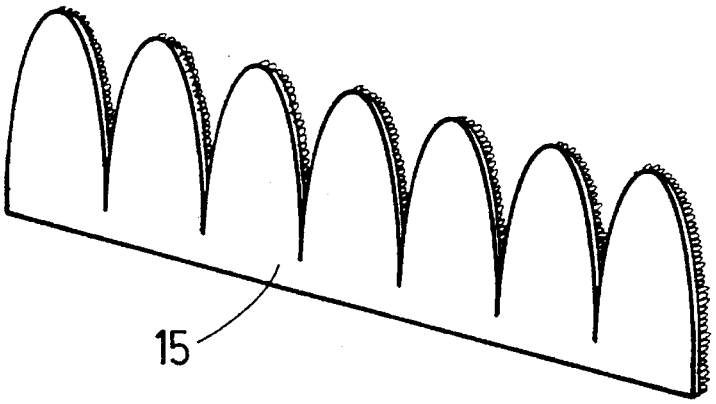
FIG. 3 is a perspective view of a portion of the conformal layer of material having minute hook-shaped gripping elements thereon.

As illustrated, for example, in FIG. 2B, the curler body and the layer of hair gripping material are each shown to include a plurality of apertures 25 therein for allowing air to pass into and out from the interior cavity of body 100. These apertures or slots allow air to flow through the curler in order to reduce the time needed for the hair on the curler to dry. The vented spherical curler 200 is particularly useful when using devices for drying hair such as a hair dryer.

It is noted that the apertures 25 illustrated in FIG. 2B have the shape of slits extending longitudinally about a spherical curler 200. However, other shapes and orientations of apertures 25 may be incorporated into the spherical curler of the present invention without departing from its scope, so long as the respective shape and orientation of the apertures allows for air to pass through the interior cavity of the curler to thereby reduce the time needed for the hair to dry. Additionally, an alternate embodiment of the spherical curler of the present invention (not shown) is envisioned where the curler includes no apertures, and therefore does not permit air to pass through the interior of the curler.

Additionally, as shown in FIGS. 2A and 2B, spherical curler 200 may include at least one receptacle 27 disposed within body 100 for receiving a shaft of a handle (not shown), wherein the receptable includes means for transferring torsional force exerted by the shaft to the body 100 to thereby cause the body to rotate as the shaft rotates. The inclusion of a receptacle 27 within curler 200 allows the curler to be attached, for example, to the shaft of a hairbrush or to the shaft of an automated hair winding device. In the embodiment shown in FIGS. 2A and 2B, the receptacle 27 has a rectangular cross-section which permits it to be mated with a rectangular shaft, similar to many socket hand tools. It is to be understood that the cross-sectional shape of the receptacle 27 may be comprised of any one of a number of different designs so long as the design prevents a shaft inserted into the receptacle from slipping when the shaft is rotated.

In the embodiment depicted in FIGS. 2A and 2B, the receptacle 27 is incorporated into flanged cap pieces 5 and 10, which have necks that are inserted into the crown of hemispheres 7 and 8, respectively. Cap pieces 5 and 10 may be secured to body 100 by any one of a number of techniques commonly known to those skilled in the art such as, for example, by the use of adhesives, or ultrasonic welding. Additionally, it is noted that the flanges on the cap pieces 5 and 10 function to hold and secure the tips of the hair gripping materials 6 and 9 after each piece of material has been conformed onto the surface at body 100. Although not shown, cap pieces 5 and 10 may also be covered with hair gripping material. This is advantageous in that, by covering the entire outer surface of the curler 200 with hair gripping material, hair may be more easily wound upon the curler. Furthermore, it is desirable for cap pieces 5 and 10 fit flush against body 100 in order to maintain the spherical shape of the curler. To accomplish this, for example, a recess or indentation (not shown) may be incorporated into the respective north and south poles of body 100.

In an alternate embodiment (not shown), the spherical curler of the present invention does not include a receptacle 27 for receiving a shaft of a handle. In such an embodiment, the spherical curler may be rolled by hand, without the use of a hairbrush handle or a motorized winding device.

FIG. 2B is a perspective view showing the assembled spherical curler of FIG. 2A. The unique shape of the spherical curler allows for a variety of differing techniques for curling and styling hair which heretofor have not been possible using conventional, cylindrical curlers. For example, because of the spherical shape of the curler of the present invention, hair is able to be wound around the curler in a plurality of directions.

Conventionally, cylindrical curlers are only able to rotate about a single axis of rotation, wherein the hair is wound in a single direction starting from its end, and continuing up until the cylindrical curler reaches the scalp. Thus, conventional cylindrical curlers only permit hair to be wound and unwound along a relatively uni-directional path, as defined by the curlers' longitudinal axis of rotation.

In contrast, the spherical shape of the curler of the present invention permits the curler to be rotated along a virtually unlimited number of axes of rotation. Thus, rather than being constrained to merely rolling the curler up and back along a uni-directional path, the spherical curler of the present invention may be wound in any number of directions. Furthermore, the rotational direction of the curler may be changed while a lock of hair is being wound upon it. Thus, for example, a first portion of a lock of hair may be wound by rotating a spherical curler about a first axis of rotation and, after the lock of hair has been partly wound about the curler, the curler may then be rotated along a second and different axis of rotation until the remaining portion of that lock of hair has been completely wound upon the curler. Such a technique for winding hair upon a spherical curler allows for the unexpected advantage of enabling a user or hairstylist to create a plurality of new and different hairstyles which cannot be created using conventional, cylindrical curlers.

Figure 4:
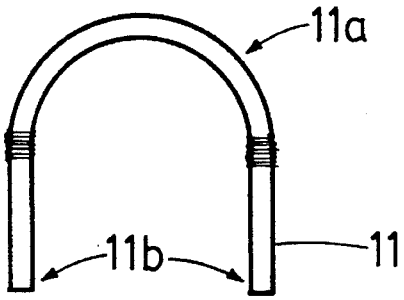
FIG. 4 illustrates a frontal view of a spherical curler clip to be used in conjunction with the spherical curler of the present invention.

FIG. 4 illustrates a frontal view of a spherical curler clip 11 which can be used in conjunction with the spherical curler 200 of the present invention, as illustrated, for example, in FIG. 1A. As illustrated in FIG. 3, clip 11 has a semi-circular end 11*a* which is slightly larger than the diameter of sphere 200. The opposite ends of the clip at 11*b* are slightly tapered inward in order to allow the clip to grasp sphere 200 in a pinching action. Curler clip 11 is preferably made from a flexible, resilient material such as, for example, spring steel or nylon, which allows the ends 11*b* of the clip to be flexed open so that curler 200 and the hair wound upon it may be placed between the two ends 11*b*. Thereafter, when the ends are released, a snap effect results, causing the clip to secure itself around the curler and the hair, thereby trapping and holding the wound hair between the clip 11 and curler 200, as shown for example, in FIG. 1A.

Figure 5:
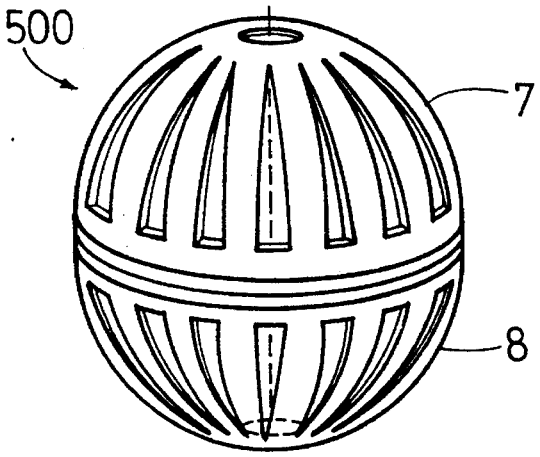
FIG. 5 illustrates an alternate embodiment of the present invention wherein the conformal layer of material having a multiplicity of hook-shaped gripping elements is not provided on the outer surface of the curler 500.

FIG. 5 illustrates an alternate embodiment of the present invention wherein the conformal layer of hair gripping material 15 (FIG. 3) is not provided on the outer surface of the curler 500. This embodiment is particularly useful for hairstyling applications similar to those using a perm rod. Additionally, one advantage of not using hair gripping material on the spherical curler 500 is that the "look" of the hair will be smoother and/or less frizzy compared to the look obtained, for example, by using spherical curler 200.

As commonly known to those skilled in the art, a perm rod is used to produce a permanent shape in the hair by applying a chemical solution (i.e. perm solution) to the hair while it is wrapped around the perm rod. Instead of the new style lasting until the next hair wash, the shape is more permanent, lasting through several washes.

However, unlike conventional perm rods, the spherical curler of the present invention may be used in place of a perm rod to allow a user or hairstylist to create any one of a number of new and different hairstyles which cannot be achieved using conventional perm rod techniques. Such new and different hairstyles are discussed in greater detail above, and therefore will not be repeated.

One technique for using the spherical curler 500 in place of a perm rod is to wind a first portion of hair around the spherical curler 500. Next, a perm solution is applied to the hair which is wrapped around the curler and soaked. The applied perm solution is allowed to remain in the hair for a predetermined period of time sufficient to cause the hair to set, after which the solution is rinsed from the hair with water. A neutralizer is then applied to the hair and rinsed out. After the neutralizer has been rinsed out, the hair is unwound from the spherical curler, and allowed to dry. The hair will then retain its uniquely shaped permanent hairstyle. Moreover, as with conventional cylindrical curlers, the uniqueness of the shapes of the locks of hair using the speherical curler of the present invention can not be achieved using a conventional perm rod.

Additionally, in order to secure the hair in place around the spherical curler, a curler clip 11 may be used as previously described above. It is to be noted that although the spherical curler 500 is depicted without the layer of hair gripping material on its outer surface, it is also possible to use the embodiment of the spherical curler shown in FIG. 2B for permanent hairstyling applications as well.

Figure 6:
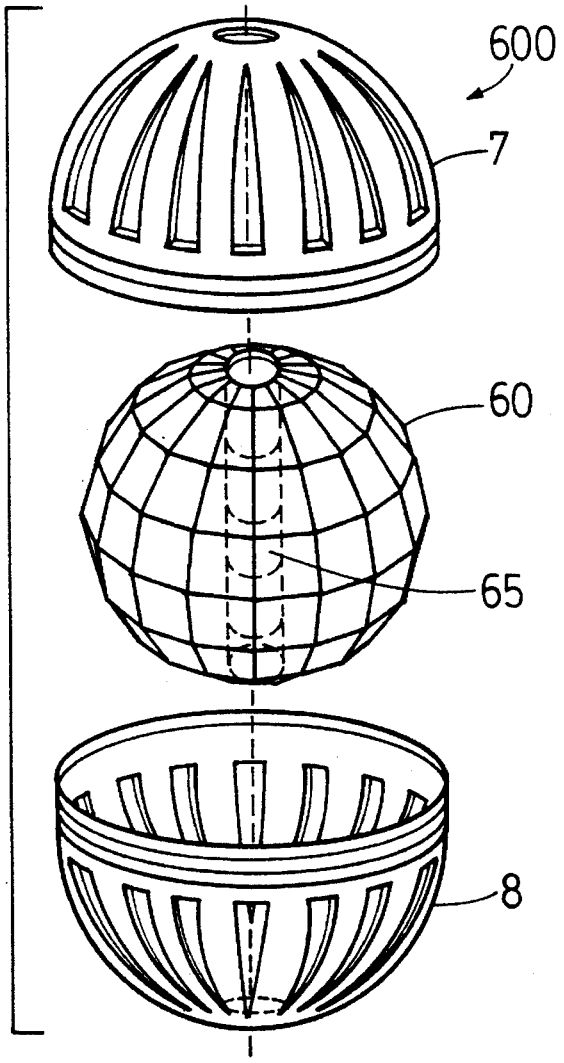
FIG. 6 is an illustration of an alternate embodiment of the present invention wherein an interior body of thermally conductive material is included within the curler 600.

FIG. 6 illustrates a spherical curler which can be used for hot-curler application, wherein the interior portion of the curler is heated. The embodiment illustrated in FIG. 6 shows a substantially spherical interior body 60, which is included within the inner cavity of the exterior body 100. The interior body 60 is preferably comprised of a thermally conductive material such as, for example, metal, and includes a receptacle 65 disposed about the diameter of the interior body for coupling a portion of body 60 to a thermal heat source.

In its application, the spherical curler of FIG. 6 may first be mounted onto a shaft which heats the interior, thermally conductive body 60. Once the spherical curler 600 is heated, it may then be applied to a user's hair using one of the techniques described above. A curler clip 11 may additionally be used to secure the hair around the heated spherical curler.

In the embodiment shown in FIG. 6, exterior body portions 7 and 8 should preferably be made of a heat-resistant material such as, for example, high temperature plastic or metal. Additionally, the interior body 60 should preferably be made of a lightweight, thermally conductive material so that the user does not experience an undue burden of weight on his or her head while the curlers are setting the hair.

In an alternate embodiment of the present invention, such as, for example, where hemispheres 7 and 8 are made of metal, the interior body 60 may be omitted. In such an embodiment, the metal curler would resemble the curler 500 of FIG. 5. The curler could then be heated, for example, by exposing it to a stream of warm or hot air. Additionally, in order to avoid injury to the user, a thin insulative layer of plastic may be applied to the exterior of the metal, spherical curler so that the curler could still be handled by the hand without burning. Once the hair is wrapped around the curler, the heat retained by the metal portions will radiate outward in a manner similar to that of conventional, cylindrical hot curlers. Additionally, although not illustrated, the heated spherical curler 600 may also include a plurality of tiny prongs (or protrusions) on its outer surface in order to help the hair catch onto the curler during winding.

Although several preferred embodiments of this invention have been described in detail herein with reference to the accompanying drawings, it is to be understood that the invention is not limited to these precise embodiments, and that various changes and modifications may be affected therein by one skilled in the art without departing from the scope or spirit of the invention as defined in the appended claims.

What is claimed is:

1. A hair styling device comprising:

a curler having a substantially spherical body, said body having an outer surface and an interior cavity;

said body having at least one receptacle disposed therein for receiving a shaft of a handle, said receptacle including means for transferring torsional force exerted by said shaft to said body to thereby cause said body to rotate.

2. The device of claim 1 wherein said curler further includes a conformal layer of material covering at least a portion of said outer surface of said body, wherein said layer of material includes a plurality of minute hook-shaped gripping elements for gripping hair of a user.

3. The device of claim 2, wherein said body and said layer of material include a plurality of apertures therein for allowing air external to said curler to flow through said interior cavity.

4. The device of claim 2 wherein said receptacle includes at least one flange overlapping and securing end portions of said layer of material.

5. The device of claim 1 wherein said body includes two hemispherical bodies which are joined together by an adhesive.

6. The device of claim 1 further comprising a spring clip for trapping and holding hair between said curler and said clip.

7. The device of claim 6 wherein said clip is comprised of a flexible, resilient material, and wherein an end portion of said clip has a substantially semi-circular shape with a diameter that is larger than a diameter of said body.

8. A hair styling device comprising:

a curler having a substantially spherical body, said body having an outer surface and an interior cavity;

a conformal layer of material covering at least a portion of said outer surface of said body, wherein said layer of material includes a plurality of minute hook-shaped gripping elements for gripping hair of a user; and wherein said body and said layer of material include a plurality of apertures therein for allowing air to flow into and out of said interior cavity.

9. The device of claim 8, wherein said curler further includes at least one multi-sided receptacle disposed therein for receiving a shaft of a handle.

10. A hair styling device comprising:

a curler having a substantially spherical exterior body, said exterior body having an outer surface and an interior cavity; and a substantially spherical interior body located within said interior cavity, said interior body comprising a thermally conductive material, said interior body further including a recepticle disposed about a diameter of said interior body for coupling to a thermal heat source.

11. The device of claim 10 wherein said exterior body includes a plurality of apertures therein for allowing air to flow into and out of said interior cavity.

12. A method for styling hair using at least one hair styling curler, said curler having a substantially spherical body, said curler further including a conformal layer of material covering at least a portion of an outer surface of said body, said layer of material including a plurality of minute hook-shaped gripping elements, said method comprising the steps of:

(a) applying said curler to a portion of hair of a user in a manner to engage said gripping elements with said hair portion;

(b) rotating said curler about a first axis in a manner to wind at least a first portion of said hair portion about said curler, and (c) rotating said curler about a second axis in a manner to wind at least a second portion of said hair portion about said curler, wherein said second axis is different from said first axis.

13. The method of claim 12 further comprising the step of repeating steps (a)–(c) with at least one additional curler.

14. The method of claim 12 further comprising the step of heating said curler with a heating device before the curler is applied to said hair portion.

15. A method for styling hair using at least one hair styling curler, said curler having a substantially spherical body, said curler further including a conformal layer of material covering at least a portion of an outer surface of said body, said layer of material including a plurality of minute hook-shaped gripping elements, said method comprising the steps of:

(a) applying said curler to a portion of hair of a user in a manner to engage said gripping elements with said hair portion;

(b) rotating said curler about a first axis of rotation in a manner to wind at least a first portion of said hair portion about said curler, and (c) changing the axis of rotation of said curler before said hair portion is completely wound about said curler.

16. The method of claim 15, wherein said changing step (c) includes the step of rotating said curler about a second axis in a manner to wind at least a second portion of said hair portion about said curler.

17. The method of claim 15 further comprising the step of heating said curler with a heating device before the curler is applied to said hair portion.

18. A method for styling hair comprising the steps of:

(a) winding a first portion of hair of a user around a spherical curler;

(b) applying a perm solution to said wound hair portion;

(c) removing said applied perm solution from said hair portion after an amount of time has elapsed sufficient to allow said applied perm solution to set said hair portion; and (d) unwinding said hair portion from said curler after said applied perm solution has been removed therefrom.

19. The method of claim 18 further including the steps of:

securing said wound hair portion about said curler using a hair securing device before said perm solution is applied; and removing said hair securing device before unwinding said hair portion from said curler.

20. The method of claim 18 wherein said winding step (a) includes the steps of:

rotating said curler about a first axis of rotation in a manner to wind at least a first portion of said hair portion about said curler, and changing the axis of rotation of said curler before said hair portion is completely wound about said curler.

* * * * *